United States Patent [19]

Lehmann

[11] 4,195,776

[45] Apr. 1, 1980

[54] MODEL VEHICLE RACE TRACK

[75] Inventor: Roger W. Lehmann, Belle Mead, N.J.

[73] Assignee: Aurora Products Corporation, West Hempstead, N.Y.

[21] Appl. No.: 871,687

[22] Filed: Jan. 23, 1978

[51] Int. Cl.[2] ..... A63H 18/02

[52] U.S. Cl. ..... 238/10 F; 104/53; 238/10 C

[58] Field of Search ..... 238/10 R, 10 A, 10 B, 238/10 C, 10 E, 10 F; 104/53, 60, 147 A, DIG. 1; 46/1 K, 216; 273/86 R, 86 B

[56] References Cited

U.S. PATENT DOCUMENTS

| | | | |
|---|---|---|---|
| 3,243,120 | 3/1966 | Lingard et al. | 238/10 F |
| 3,592,384 | 7/1971 | Tomaro | 238/10 E |
| 3,830,426 | 8/1974 | Martin | 238/10 F |
| 3,854,405 | 12/1974 | Martin | 104/60 |
| 3,898,723 | 8/1975 | Kirby et al. | 238/10 F X |
| 4,091,995 | 5/1978 | Barlow et al. | 238/10 A |

*Primary Examiner*—Randolph A. Reese
*Attorney, Agent, or Firm*—Blum, Kaplan, Friedman, Silberman & Beran

[57] ABSTRACT

A track section for model vehicles adapted to be interconnected with like adjacent track sections includes a longitudinally extending body having a top wall, first and second end faces and first and second sides. First and second teeth extend transversely from the body proximate the sides and the end faces in transversely opposite directions away from the centers of the end faces. First and second receiving members are fixed relative to the body proximate the sides and the end faces, each receiving member defining a recess adapted to receive a corresponding tooth of a like adjacent track section. First and second transverse flexion stabilizing members project longitudinally outward relative to the respective first and second receiving members. First and second lugs are mounted to the sides of the body proximate the teeth, each lug defining a cavity adapted to receive a corresponding transverse flexion stabilizing member of a like adjacent track section. Holding elements are mounted to each of the end faces for releaseable inter-engagement with holding elements of a like adjacent track section to resist lateral movement between the track sections upon the track sections being laterally engaged, with a tooth of each track section being received by a recess of a like adjacent track section.

10 Claims, 8 Drawing Figures

FIG. 1.
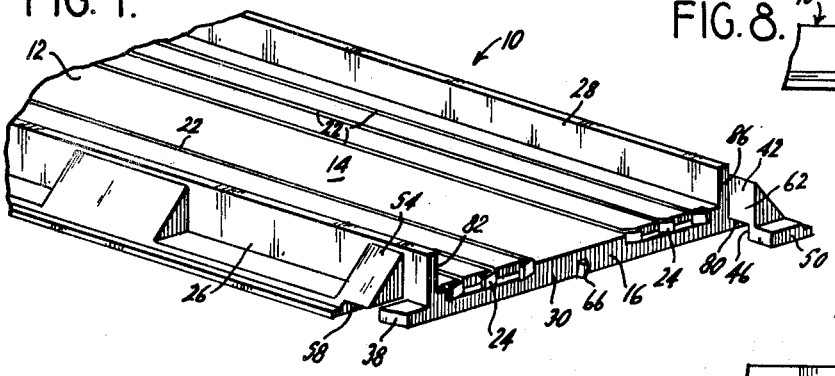
FIG. 8.
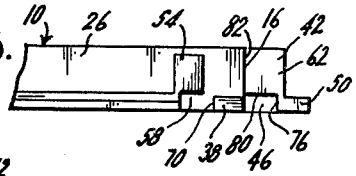
FIG. 3.
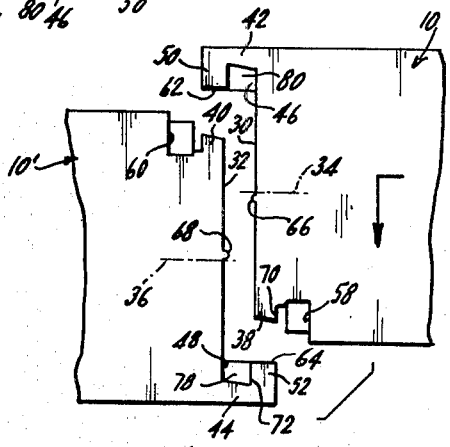
FIG. 2.
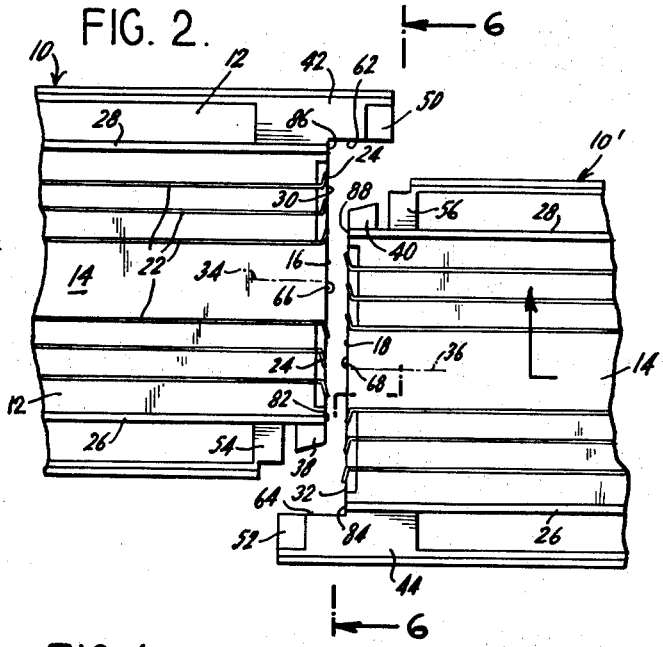
FIG. 5.
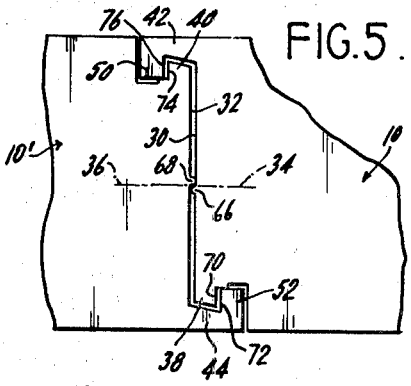
FIG. 4.
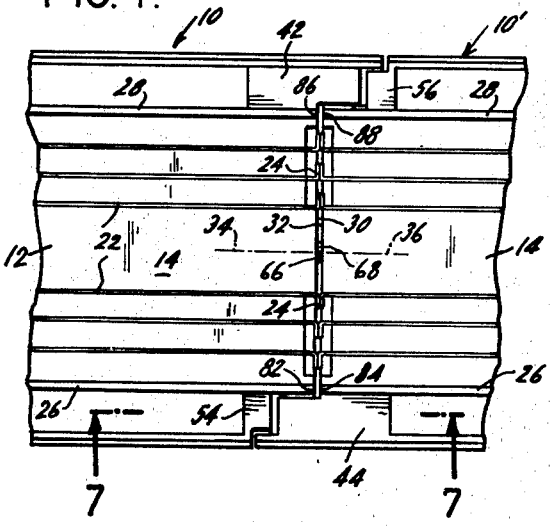
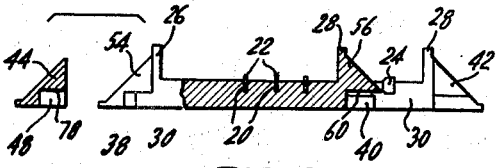
FIG. 6.
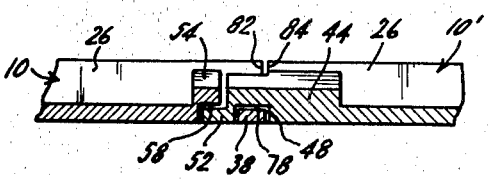
FIG. 7.

MODEL VEHICLE RACE TRACK

The present invention relates generally to model racing vehicles, and in particular to track sections for use therewith.

In recent years, model racing vehicles and tracks adapted to be used with them have become extremely popular. However, a chronic problem with tracks for toy vehicles has been the need for a track section having a locking mechanism to connect like adjacent track sections which allows the track sections to be releasably interconnected, while at the same time securely interconnecting the track sections so that they cannot be unintentionally displaced with respect to one another in any of several possible modes.

For example, a locking mechanism for track sections must, of course, prevent track sections from being pulled apart from one another in a longitudinal direction. It should also provide a mechanism to prevent the tracks from being disengaged by relative lateral motion in either direction. Further, it is desirable to prevent adjacent track sections from being flexed relative to one another about a lateral axis coinciding with the line of contact between the track sections, and also from being flexed about an axis perpendicular to the plane of the top wall of the track sections. Naturally, provisions must be made whereby the track sections, when desired, can be disassembled from one another by the exertion of a moderate force in the appropriate direction.

A further recurring problem with existing track sections has been that portions of the locking mechanism are designed so that often portions thereof have been broken off the track section. Specifically, track section locking mechanisms often include a relatively thin member projecting longitudinally from the end face of a track section, with a tooth projecting laterally from the remote end of the longitudinal member. There is thus provided a projection from a projection which is susceptible of being caught in the receiving window of another track section, or elsewhere, and being broken off.

A similar problem with prior art track sections is that a fully enclosed window must often be provided to receive the corresponding hook of a like track section. However, it is often quite difficult to produce such windows to the appropriate tolerance, and it has often been found that the hooks do not properly fit into the windows. In addition, windows have a tendency to fill up with dirt and other materials, which similarly prevents a proper fit.

It is therefore an object of the present invention to provide an improved model vehicle track section which is capable of interconnection with like track sections whereby such interconnected track sections cannot be substantially displaced with respect to one another except, when desired, to separate from each other in a predetermined manner.

It is another object of the present invention to provide a model vehicle track construction which is free of projections from projections which are susceptible of being broken off from the track section.

It is yet another object of the present invention to provide a model vehicle track section which is free of fully enclosed windows for interconnection with projections from like adjacent track sections.

In an illustrative embodiment demonstrating certain aspects of the present invention, a track section for model vehicles adapted to be interconnected with like adjacent track sections includes a longitudinally extending body having a longitudinally extending top wall having first and second ends and adapted to receive model vehicles. First and second longitudinally extending sides are fixed to either side of the top wall. First and second end faces are fixed respectively to the first and second ends of the top wall, each of the end faces having a center. A first tooth extends transversely from the body proximate the first side and the first end face. A second tooth substantially identical to the first tooth extends transversely from the body proximate the second side and the second end face, the first and second teeth extending in transversely opposite directions away from the centers of the first and second end faces respectively. A first receiving member is fixed relative to the body proximate the second side and the first end face. A second receiving member is fixed relative to the body proximate the first side and the second end face. Each of the receiving members defines a recess adapted to receive a corresponding tooth of a like adjacent track section. Holding means are mounted to each of the end faces for releasable inter-engagement with holding means of a like adjacent track section to resist lateral movement between the track sections upon the track sections being laterally engaged with a tooth of each track section being received by a recess of the like adjacent track section.

The above brief description as well as further objects, features and advantages of the present invention will be more fully understood by reference to the following detailed description of a presently preferred, but nonetheless illustrative embodiment in accordance with the present invention, when taken in conjunction with the accompanying drawing, wherein:

FIG. 1 is a fragmentary perspective view of a representative form of the present invention;

FIG. 2 is a fragmentary top plan view showing an adjacent pair of like track sections of the present invention, with the track sections not connected, illustrating the interrelation between the locking mechanisms of said track sections;

FIG. 3 is a fragmentary bottom plan view, on a reduced scale, of the track sections of FIG. 2;

FIG. 4 is a fragmentary top plan view showing an adjacent pair of like track sections interconnected in end-to-end relationship;

FIG. 5 is a fragmentary bottom plan view, on a reduced scale, of the track sections of FIG. 4;

FIG. 6 is a right side sectional elevational view taken substantially along the line 6—6 of FIG. 2, and looking in the direction of the arrows;

FIG. 7 is a right side sectional elevational view taken substantially along the line 7—7 of FIG. 4, and looking in the direction of the arrows; and FIG. 8 is a fragmentary side elevational view of a track section of the present invention illustrating the locking mechanism.

Referring now specifically to the drawing and first to FIG. 1, there is shown an illustrative track section embodying features of the present invention, generally designated by the reference numeral 10. Inasmuch as the track section of the present invention is adapted to be interconnected with a like adjacent track section, a second track section identical to track section 10 will be designated as 10', and is shown in FIGS. 2 through 7. Due to substantial identity in appearance throughout its middle part, no single track section of the present invention is shown in full. However, it will be understood that the left-hand end of track section 10 has the same configuration as the left-hand end of track section 10'. Accordingly, although the left-hand end of track section 10, which is not shown in the drawing, is identical to the left-hand end of track section 10', which is shown, the same reference numerals will be used to indicate the corresponding portions of track sections 10 and 10'.

The track section 10 has a longitudinally extending body 12 which is formed of insulating material such as by being molded of plastic. The body 12 may be of any shape or configuration, including curved, with portions thereof at different levels to form part or all of a banked curve or a portion of virtually any desired track configuration. However, for simplicity of description, the body 12 of track sections 10 and 10' is shown as being of a generally straight, elongated configuration, extending in a longitudinal direction coincident with the direction of travel of the model vehicles.

Longitudinally extending body 12 of track section 10 has a longitudinally extending top wall 14 and bottom wall 14' parallel to and spaced from the top wall. The top wall 14 has a first end 16 and a second end 18 with the top wall being adapted to receive model vehicles.

In the present illustrative embodiment, the top wall 14 includes a series of longitudinally extending grooves 20 which are adapted to receive longitudinally extending metallic conductors 22. As is well known in the prior art, such an arrangement can be advantageously used to provide electric current to power and guide model vehicles. End tabs 24 are provided at the ends of metallic conductors 22 to allow for electrical interconnection between like adjacent track sections when they are interconnected in a manner to be described, as best seen in FIG. 4. It will be understood that the top wall 14 could also include a longitudinally extending slot adapted to receive a protrusion from a model vehicle to mechanically guide such a vehicle along the track.

The longitudinally extending body 12 includes a first longitudinally extending side 26 and a second longitudinally extending side 28, which are both fixed to either side of the top wall 14. First end face 30 is fixed to the first end 16 of the top wall 14; and a corresponding second end face 32 is fixed to the second end 18 of the top wall 14. A first end face 30 has a center designated by center line 34, and a second end face 32 has a center designated by center line 36.

As best seen in FIGS. 1, 2 and 8, a first tooth 38 extends transversely from the first side 26 of body 12 proximate the first end face 30. Similarly, a second tooth 40, which is substantially identical to the first tooth 38, extends transversely from the second side 28 of the body 12 proximate the second end face 32. It will be appreciated that on any given individual track section 10 or 10', the first tooth 38 and the second tooth 40 extend in transversely opposite directions. Specifically, the first tooth 38 extends away from the center 34 of the first end face 30, while the second tooth 40 extends away from the center 36 of the second end face 32.

As best seen in FIGS. 3 and 5, the teeth 38 and 40 extend directly from and are formed integrally with the body 12. Such construction provides substantial strength to the teeth 38 and 40, since they project directly from the body 12 and not from projections, as is true of other tracks.

A first receiving member 42 is fixed relative to the body 12 and extends laterally from the second side 28 of the body 12 proximate the first end face 30 and longitudinally from the body 12 relative to the first end face 30 in a direction away from the second end face 32, as best seen in FIGS. 1, 2 and 8. Similarly, a second receiving member 44 is fixed relative to the body 12 and extends laterally from the first side 26 of the body 12 proximate the second end face 32 and longitudinally from the body 12 relative to the second end face 32 in a direction away from the first end face 30. As can best be seen in FIGS. 1, 3 and 8, the first receiving member 42 defines a recess 46 which is adapted to receive a corresponding tooth 40 of a like adjacent track section or a corresponding tooth 38 of a like adjacent track section which has been rotated 180° about an axis perpendicular to the top wall 14. Similarly, the second receiving member 44 defines a recess 48 (see FIGS. 3, 6 and 7) which is similarly adapted to receive a corresponding tooth 38 of a like adjacent track section or a corresponding tooth 40 of a like adjacent track section which has been rotated 180° about an axis perpendicular to the top wall 14. As best seen in FIGS. 1 and 3, the recesses 46 and 48 are open at their bottoms, and thus do not provide the type of fully enclosed window that is often found in the prior art and which often poses various difficulties, as previously discussed.

As best seen in FIG. 6, the receiving members 42 and 44 are formed from triangular ribs, which provide a streamlined appearance and enhance the structural integrity of the receiving members. The triangular ribs are joined to the sides 26 and 28 to provide support to the receiving members 42 and 44.

In the illustrative preferred embodiment of the present invention, the track section 10 also includes a first transverse flexion stabilizing member 50 projecting longitudinally outward relative to the first receiving member 42, in a direction away from the second end face 32 of the track section 10. Similarly, a second transverse flexion member 52 substantially identical to the first transverse flexion stabilizing member 50, projects longitudinally outward relative to the second receiving member 44 in a direction away from the first end face 30.

As best seen in FIGS. 1 and 8, a first lug 54 is mounted to the first side 26 of the body 12 proximate the first tooth 38 between the first tooth 38 and the second end face 32. Similarly, a second lug 56 is mounted to second side 28 of body 12 proximate the second tooth 40 between the second tooth 40 and the first end face 30. As seen most advantageously in FIGS. 6, 7 and 8, the lugs 54 and 56 define cavities 58 and 60, respectively. The cavities 58 and 60 are open at their bottoms and are adapted to receive corresponding transverse flexion stabilizing members 52 and 50 of a like adjacent track section.

As best seen in FIG. 1, the lugs 54 and 56 are formed from triangular ribs, which provide a streamlined appearance and enhance the structural integrity of the lugs.

In the presently preferred embodiment, as best illustrated in FIGS. 1 and 2, the first receiving member 42 and the first transverse flexion stabilizing member 50 have a first common flat surface 62. Similarly, the second transverse flexion stabilizing member 52 and the second receiving member 44 have a second common flat surface 64. The first common flat surface 62 and the second common flat surface 64 face in transversely opposite directions. Specifically, the first common flat surface 62 faces toward center line 34 of the first end face 30, while second common flat surface 64 faces toward center line 36 of the second end face 32.

Holding means are mounted to each of the end faces 30 and 32 for releasable inter-engagement of track section 10 with a like adjacent track section 10'. As best seen in FIGS. 1 and 2, the holding means preferably comprises a tongue 66 projecting from the first end face 30 adjacent to the center line 34 and between the center line 34 and the first tooth 38. Similarly, a tongue 68 projects from the second end face 32 adjacent to the center line 36 and between the center line 36 and the second tooth 40. As will be described below, the tongues 66 and 68 are constructed and arranged to interfere with and pass over each other on like adjacent track sections when two track sections of the present invention are inter-engaged.

The interconnection between two like track sections of the present invention is accomplished as follows. A track secton 10 is brought adjacent to a like track section 10', as illustrated in FIGS. 2 and 3. First end face 30 of track section 10 is brought adjacent to second end face 32 of track section 10'. It will be appreciated that the end faces 30 and 32 cannot be brought completely flush against one another due to the tongues 66 and 68 projecting from end faces 30 and 32.

Since the tongues 66 and 68 are adjacent to the respective center lines 34 and 36, when the track sections 10 and 10' are brought together preparatory to interconnection, the tongue 66 will be in a position adjacent tongue 68 of track section 10' (above it as viewed in FIG. 2). When the track sections 10 and 10' are thus aligned, with their respective top surfaces 14 facing in the same direction (i.e. up in FIG. 2), the track sections are ready to be interconnected. To complete the interconnection, the track sections 10 and 10' are moved laterally toward one another (track section 10 up, and track section 10' down as viewed in FIG. 2). The first tooth 38 of the track section 10 is received in the recess 48 of the second receiving member 44 of the track section 10'. Similarly, the second tooth 40 of the track section 10' is received in the recess 46 of the first receiving member 42 of the track section 10.

In a similar manner, the first transverse flexion stabilizing member 50 of the track section 10 is received in the cavity 60 of the track section 10'. Likewise, the second transverse flexion stabilizing member 52 of the track section 10' is received in the cavity 58 of the first track section 10.

It will be appreciated that as the track sections 10 and 10' are laterally engaged, with a tooth of each track section being received by a recess of a like adjacent track section, tongues 66 and 68 initially interfere with and finally pass over each other whereby the track sections 10 and 10' are releasably inter-engaged in a manner to resist lateral movement between them.

A pair of track sections 10 and 10' of the present invention in their fully interconnected position is illustrated in FIGS. 4, 5 and 7. It will be appreciated that the track sections 10 and 10' cannot be significantly displaced with respect to one another in any direction, except to be released from one another by reversing the interconnection just described, and then only with the exertion of force. Specifically, track sections 10 and 10' cannot be pulled apart longitudinally because the inner wall 70 of the first tooth 38 of the track section 10 impacts against the inner wall 72 of the recess 48. In a similar manner, the inner wall 74 of the second tooth 40 of the track section 10' impacts against the inner wall 76 of the recess 46 of the track section 10. Further, track sections 10 and 10', once they have been interconnected, cannot be rotated with respect to each other about an axis perpendicular to the track surface shown in FIG. 4.

As can be best understood with reference to FIG. 7, the track sections of the present invention also resist being flexed relative to one another. It will be understood that if the track section 10' is twisted clockwise relative to the track section 10 as viewed in FIG. 7, the second transverse flexion stabilizing member 52 of the track section 10' will contact the first lug 54 of the track section 10 while the first tooth 38 of the track section 10 will impact against the bottom wall 78 of the recess 48 of the receiving member 44 of the track section 10'. The same types of interaction will occur between the first transverse flexion stabilizing member 50 of the track section 10 and the lug 56 of the track section 10' and between the first tooth 40 of the track section 10' and the bottom surface 80 of the recess 46 of the first receiving member 42 of the track section 10.

The track sections of the present invention, once interconnected, also resist being twisted with respect to each other about an axis parallel to center lines 34 and 36 as shown in FIG. 5, and resist being relatively displaced in an up-and-down direction, as can best be understood by reference to FIG. 7.

The track sections 10 and 10' also resist relative movement such as the counterclockwise rotation of track section 10' with respect to track section 10 as viewed in FIG. 7. Such movement is resisted primarily by the impact of the end face 82 of the side wall 26 of the track section 10 against the end face 84 of the side wall 26 of the track section 10', as well as the impact of the end face 86 of the side wall 28 of the track section 10 against the end face 88 of the side wall 28 of the track section 10'.

It will be appreciated that in the present invention, the teeth 38 and 40 of each track section extend only transversely from the body 12 proximate the respective end faces. Accordingly, such teeth are direct projections from the track body, rather than projections from projections which are susceptible to being broken off of the body. It will be appreciated that it is difficult to catch one tooth of a mating pair of track sections in the appropriate recess of the other track section without, at the same time, catching the other tooth in its appropriate recess. Therefore, it is difficult for one tooth to be snagged and bent to the point where there is a danger of it being broken off from the track body.

It will also be appreciated that the locking mechanism of the present invention does not include any fully enclosed window to receive a corresponding tooth. Specifically, the recesses 46 and 48 and the cavities 58 and 60 are open at their bottoms. Thus, deviations from design tolerances can be more readily accommodated, and there is little danger of the cavities being filled up with debris, thereby rendering them inoperative.

It will be understood that the configurations of the two ends of a track section of the present invention have the same construction, only rotated 180° about an axis perpendicular to the top wall 14. Thus, the interconnection between the first end face 30 of track section 10 and the second end face 32 of track section 10' has been described. It will be understood that either end of either track section can be interconnected with the other.

As will be readily apparent to those skilled in the art, the invention described may be used in other specific forms without departing from its spirit or essential characteristics. The present embodiment is, therefore, considered as illustrative and not restrictive, the scope of the invention being indicated by the claims rather than by the foregoing description, and all changes which come within the meaning and range of equivalence of the claims are therefore intended to be embraced therein.

What is claimed is:

1. A track section for model vehicles adapted to be interconnected with like adjacent track sections comprising: a longitudinally extending body having first and second longitudinally and laterally extending walls in spaced relation and each having first and second ends, first and second longitudinally extending sides fixed respectively to each side of said longitudinally and laterally extending walls and bridging same, and first and second end faces fixed respectively to said first and second ends of said longitudinally and laterally extending walls and bridging same, each of said end faces having a center; a first tooth extending transversely from said body proximate one of said longitudinally and laterally extending walls, said first side and said first end face; a second tooth substantially identical to said first tooth extending transversely from said body proximate one of said longitudinally and laterally extending walls, said second side and said second end face, said first and second teeth extending in transversely opposite directions away from said centers of said first and second end faces, respectively; a first receiving member fixed relative to said body proximate said second side and extending longitudinally from said first end face, said first receiving member defining a recess open both on the side thereof facing the center of said first end face and on the side thereof extending from the one of said longitudinally and laterally extending walls to which said second tooth is proximate; a second receiving member fixed relative to said body proximate said first side and extending longitudinally from said second end face, said second receiving member defining a recess open both on the side thereof facing the center of said second end face and on the side thereof extending from the one of said longitudinally and laterally extending walls to which said first tooth is proximate, each of said receiving members recess being adapted to receive a corresponding tooth of a like adjacent track section; holding means mounted to each of said end faces for releasable inter-engagement with holding means of a like adjacent track section to resist lateral movement between said track sections due to normal track usage upon said track sections being laterally engaged with a tooth of each track section being received by a corresponding recess of said like adjacent track section, while permitting relative lateral movement between said track sections for engagement and disengagement of said teeth in said recesses; a first transverse flexion stabilizing member projecting longitudinally outward relative to said first receiving member in a direction away from said second end face and in substantial registration with the recess thereof; a second transverse flexion stabilizing member projecting longitudinally outward relative to said second receiving member in a direction away from said first end face and in substantial registration with the recess thereof; a first lug mounted to said first side of said body proximate said first tooth between said first tooth and said second end face, said first lug defining a cavity open both on the side thereof facing away from the center of said first end face and on the side thereof extending from the one of said longitudinally and laterally extending walls to which said first tooth is proximate; and a second lug mounted to said second side of said body proximate said second tooth between said second tooth and said first end face, said second lug defining a cavity open both on the side thereof facing away from the center of said second end face and on the side thereof extending from the one of said longitudinally and laterally extending walls to which said second tooth is proximate, each of said cavities being adapted to receive a corresponding transverse flexion stabilizing member of a like adjacent track section, whereby said lug and said transverse flexion stabilizing members are adapted to contact each other to prevent said track sections from being flexed about a transverse axis when said track section and a like adjacent track section are engaged.

2. A track section according to claim 1 wherein said first receiving member extends laterally from said second side of said body and said second receiving member extends laterally from said first side of said body.

3. A track section according to claim 1 wherein said first tooth extends from said first side of said body and said second tooth extends from said second side of said body.

4. A track section according to claim 1 wherein said first tooth extends only transversely from said first side of said body and said second tooth extends only transversely from said second side of said body.

5. A track section according to claim 4 wherein said first receiving member extends laterally from said second side of said body and said second receiving member extends laterally from said first side of said body.

6. A track section according to claim 1 wherein said holding means comprises a tongue projecting from each of said end faces adjacent to said centers, between said centers and said teeth, said tongue being constructed and arranged to interfere with and pass over a corresponding tongue of a like adjacent track section when said track sections and a like adjacent track section are engaged with a tooth of each track section being received by a recess of a like adjacent section.

7. A track section according to claim 1 wherein said first receiving member and said first transverse flexion stabilizing member have a first common flat surface and wherein said second transverse flexion stabilizing member and said second receiving member have a second common flat surface, said first and second common flat surfaces facing in transversely opposite directions toward said centers of said first and second end faces, respectively.

8. A track section according to claim 1 wherein said lugs are formed from triangular ribs.

9. A track section according to claim 1 wherein said receiving members are formed from triangular ribs which are joined to said sides.

10. A track section according to claim 1, wherein said first and second longitudinally and laterally extending walls are the top and bottom walls of said track sections, said teeth being proximate to said bottom wall and said receiving member recesses opening on said bottom wall.

* * * * *